US007066089B1

(12) United States Patent
Shih

(10) Patent No.: US 7,066,089 B1
(45) Date of Patent: Jun. 27, 2006

(54) AUTOMATICALLY RE-INKED STAMP

(76) Inventor: Shiny Shih, No. 31, Lane 349, Chungcheng S. Rd., Yungkang, Tainan Hsien (TW)

( * ) Notice: Subject to any disclaimer, the term of this patent is extended or adjusted under 35 U.S.C. 154(b) by 0 days.

(21) Appl. No.: 11/220,077

(22) Filed: Sep. 6, 2005

(51) Int. Cl.
*B41K 1/50* (2006.01)

(52) U.S. Cl. ..... 101/334; 101/333; 101/327; 101/405; 101/406

(58) Field of Classification Search ..... 101/333, 101/334, 327, 405, 406
See application file for complete search history.

(56) References Cited

U.S. PATENT DOCUMENTS 5,826,515 A * 10/1998 Frable et al. ..... 101/483
6,058,840 A * 5/2000 Poplawski et al. ..... 101/405
6,189,450 B1 * 2/2001 Shih ..... 101/327
6,892,638 B1 * 5/2005 Sculler ..... 101/333

* cited by examiner

*Primary Examiner*—Daniel J. Colilia
*Assistant Examiner*—Kevin D. Williams
(74) *Attorney, Agent, or Firm*—William E. Pelton, Esq.

(57) ABSTRACT

An automatic re-inked stamp has a stamp base an ink pad, a character unit, a housing and a bottom cover that attaches to the stamp base without having to press the character unit down. The stamp base has a bottom, an opening at the bottom and a lip formed on and protruding out from the bottom. The ink pad is mounted slidably in the stamp base, and the character unit is rotatably mounted below the ink pad and abuts the ink pad when it moves into the stamp base. The housing has a biasing member and is mounted slidably over the stamp base. The bottom cover has two latches that hook the lip on the stamp base to hold the bottom cover securely on the stamp base.

6 Claims, 7 Drawing Sheets

AUTOMATICALLY RE-INKED STAMP

BACKGROUND OF THE INVENTION

1. Field of the Invention

The present invention relates to an automatically re-inked stamp, and particularly relates to an automatically re-inked stamp that has a stamp face and a bottom cover to conveniently prevent the stamp from inadvertently stamping.

2. Description of Related Art

Stamps with stamp faces that are automatically re-inked are popular at present. With reference to FIGS. 6 and 7, a conventional stamp includes a stamp base (40), an ink pad (41), a character unit (50), a housing (43), a biasing member (not shown) and a bottom cover (not numbered).

The stamp base (40) has a hollow body (not numbered) with a bottom (not numbered), an open end (not numbered), two end faces (not numbered), a cavity (not numbered), two guide slots (42) and two rotation protrusions (not shown). The open end is formed at the bottom of the hollow body. Each end face has an inside surface (not shown). The cavity is formed inside the hollow body, communicates with the open end and has an upper section (not numbered). The guide slots (42) are longitudinally formed respectively through the end faces of the hollow body. The rotation protrusions are formed respectively on and extend in from inside surfaces of the end faces adjacent respectively to the guide slots (42).

The ink pad (41) is mounted in the upper section of the cavity of the stamp base (40).

The character unit (50) is mounted pivotally in the cavity of the stamp base (40) below the ink pad (41), selectively communicates with the open end of the stamp base (40) and has a bottom (not numbered), two ends (not numbered), a character plate (not numbered), two lugs (51) and a shaft (52). The character plate (not numbered) is mounted at the bottom of the character unit (50). The lugs (51) are defined respectively at and protrude out from the two ends of the character unit (50). The shaft (52) is mounted longitudinally through the character unit (50) below the two lugs (51) and has two ends (not numbered). The ends of the shaft (52) protrude from the ends of the character unit (50) and are mounted slidably and pivotally respectively in the guide slots (42) in the end faces of the hollow body.

The housing (43) is mounted slidably on the stamp base (40) and has a bottom (not numbered), a hollow body and an open end (not numbered). The open end of the housing (43) is mounted slidably around the stamp base (40). Pressing the housing (43), moves the character unit (50) downward, and the lugs (51) abut the rotation protrusions (not numbered) that rotate the character unit (50) around the shaft (52) and make the character plate face downward to stamp.

The biasing member is mounted in the housing (43) between the stamp base (40) and the housing (43). When the stamping task is finished, the housing (43) is released and is returned to its original position by the biasing member. When the character unit (50) rises, the lugs (51) abut the rotation protrusions and rotate the character unit (50) so the character plate faces up and is re-inked when it comes in contact with the ink pad (41). In this way, the stamp can automatically be re-inked and facilitate stamping continuously.

However, the stamp sitting on a desk may be pressed by accident and stamp the desk or a document on which the stamp is sitting by mistake, which is annoying. Consequently, a bottom cover was designed to solve the problem. The bottom cover consists of a bottom cap (60) and two clamps (64).

The bottom cap (60) has two ends (not numbered), a front edge (not numbered), a rear edge (not numbered), a panel (61), an outer lip (62), two inner lips (63) and two mounting slots (not numbered). The panel (61) is flat and has an outer edge (not numbered), a top surface (not numbered) and two ends (not numbered). The outer lip (62) is formed on and extends up from the top surface of the panel (61) at the outer edge. The inner lips (63) are formed on and protrude up from the top surface of the panel (61) inside the outer lip (62) respectively near the front and rear edges of the bottom cap (60). The mounting slots are formed between the inner lips (63) and the outer lip (62).

The clamps (64) are defined respectively near and protrude up from the ends of the bottom cap (60) and align respectively with the ends of the shaft (52) of the character unit (50), and each clamp (64) has a distal end (not numbered) and a clamping opening (641) are respectively defined in the two clamping portions (64). When the bottom of the stamp base (40) is placed in the bottom cover and the housing (43) is pressed down, the character unit (50) moves downward, and the clamping openings (641) clamp the shaft (52) and hold the bottom cap (60) on the open end of the stamp base (40). Consequently, inadvertent stamping is effectively prevented.

However, the bottom cover cannot hold the shaft (52) until the housing (43) is pressed down, which is inconvenient. Even if the housing (43) is pressed down, the shaft (52) may not align and be clamped by the clamping opening (641), thereby causing the character unit (50) to rotate so documents or a person's hands get ink on them from the character plate.

Therefore, the invention provides an automatically re-inked stamp to mitigate or obviate the aforementioned problems.

SUMMARY OF THE INVENTION

The main objective of the present invention is to provide an automatically re-inked stamp that can effectively prevent inadvertent stamping.

The automatic re-inked stamp has a stamp base an ink pad, a character unit, a housing and a bottom cover that attaches to the stamp base without having to press the character unit down. The stamp base has a bottom, an opening at the bottom and a lip formed on and protruding out from the bottom. The ink pad is mounted slidably in the stamp base, and the character unit is rotatably mounted below the ink pad and abuts the ink pad when it moves into the stamp base. The housing has a biasing member and is mounted slidably over the stamp base. The bottom has two latches that hook the lip on the stamp base to hold the bottom cover securely on the stamp base.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
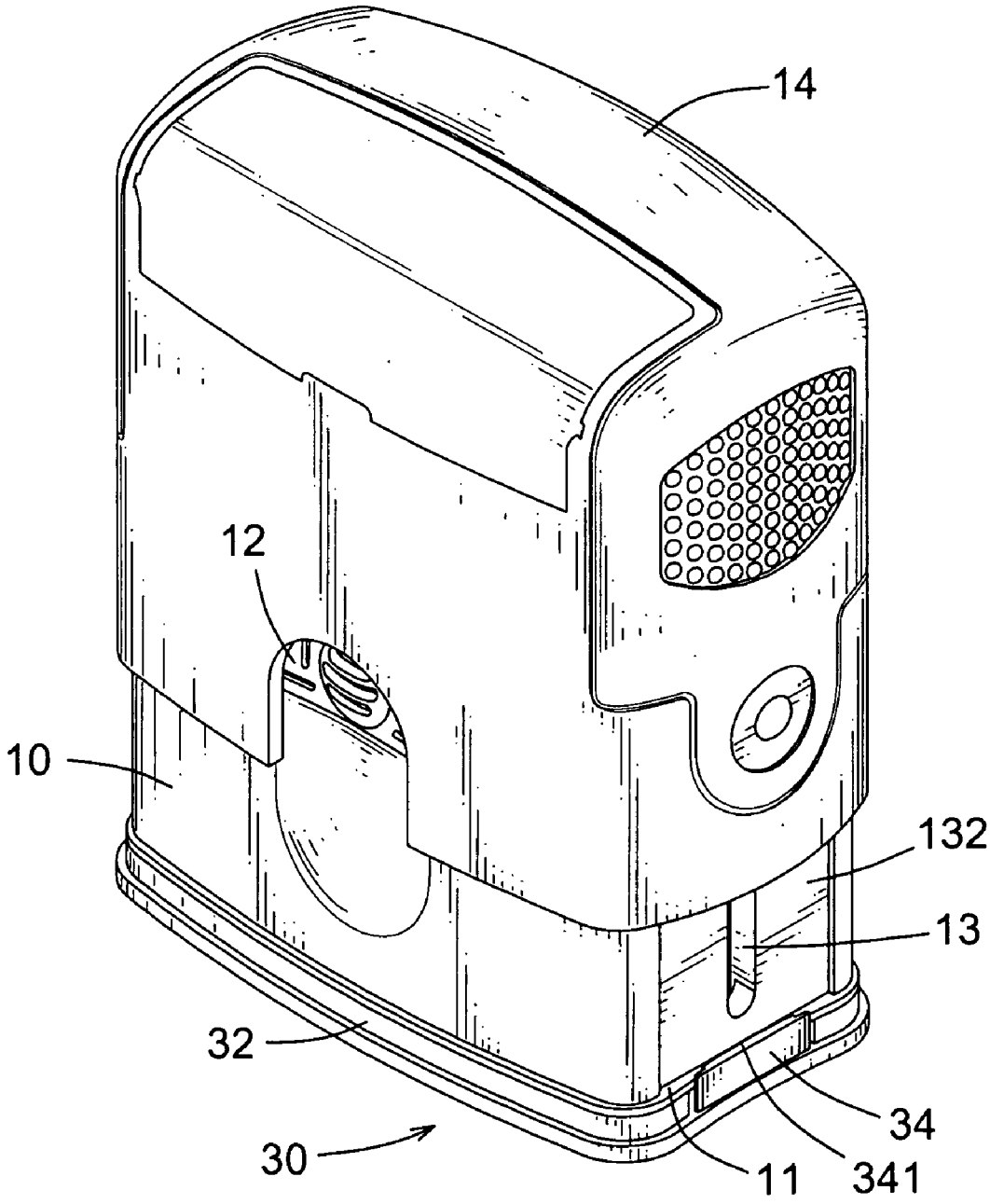
FIG. 1 is a perspective view of an automatically re-inked stamp in accordance with the present invention.
Figure 2:
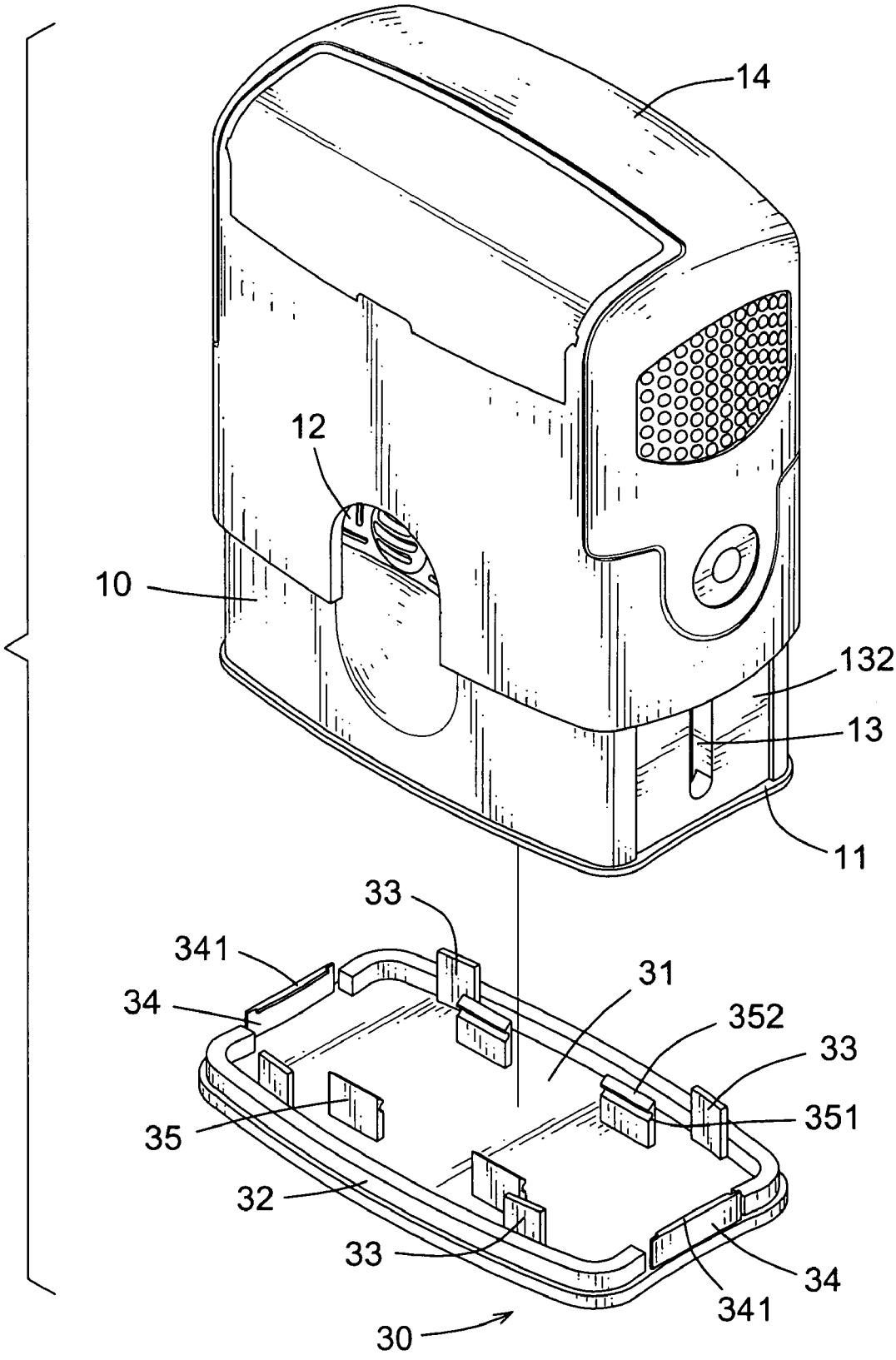
FIG. 2 is a partially exploded perspective view of the automatically re-inked stamp in FIG. 1.
Figure 3:
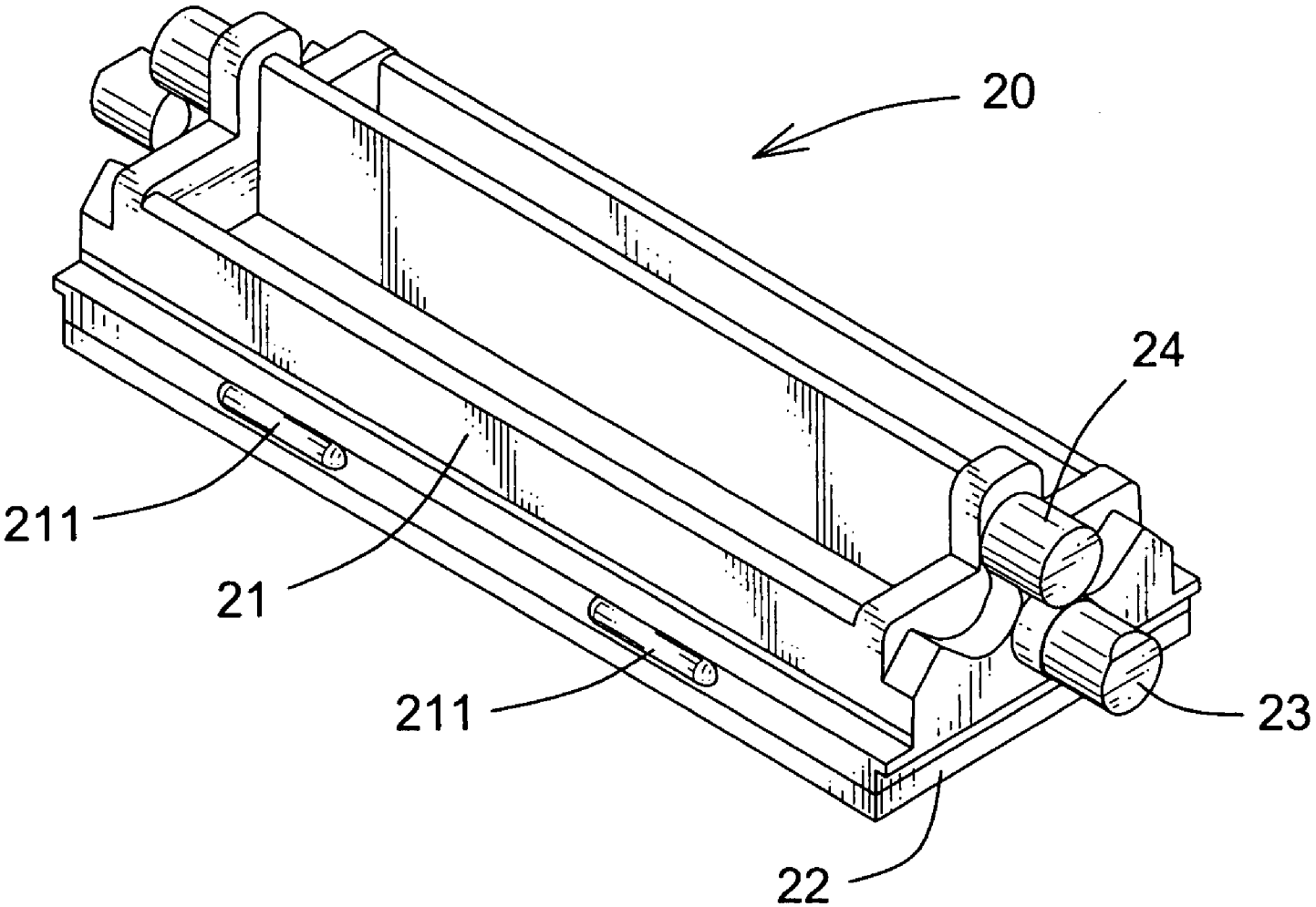
FIG. 3 is a perspective view of a character unit used in the automatically re-inked stamp in FIG. 1.
Figure 4:
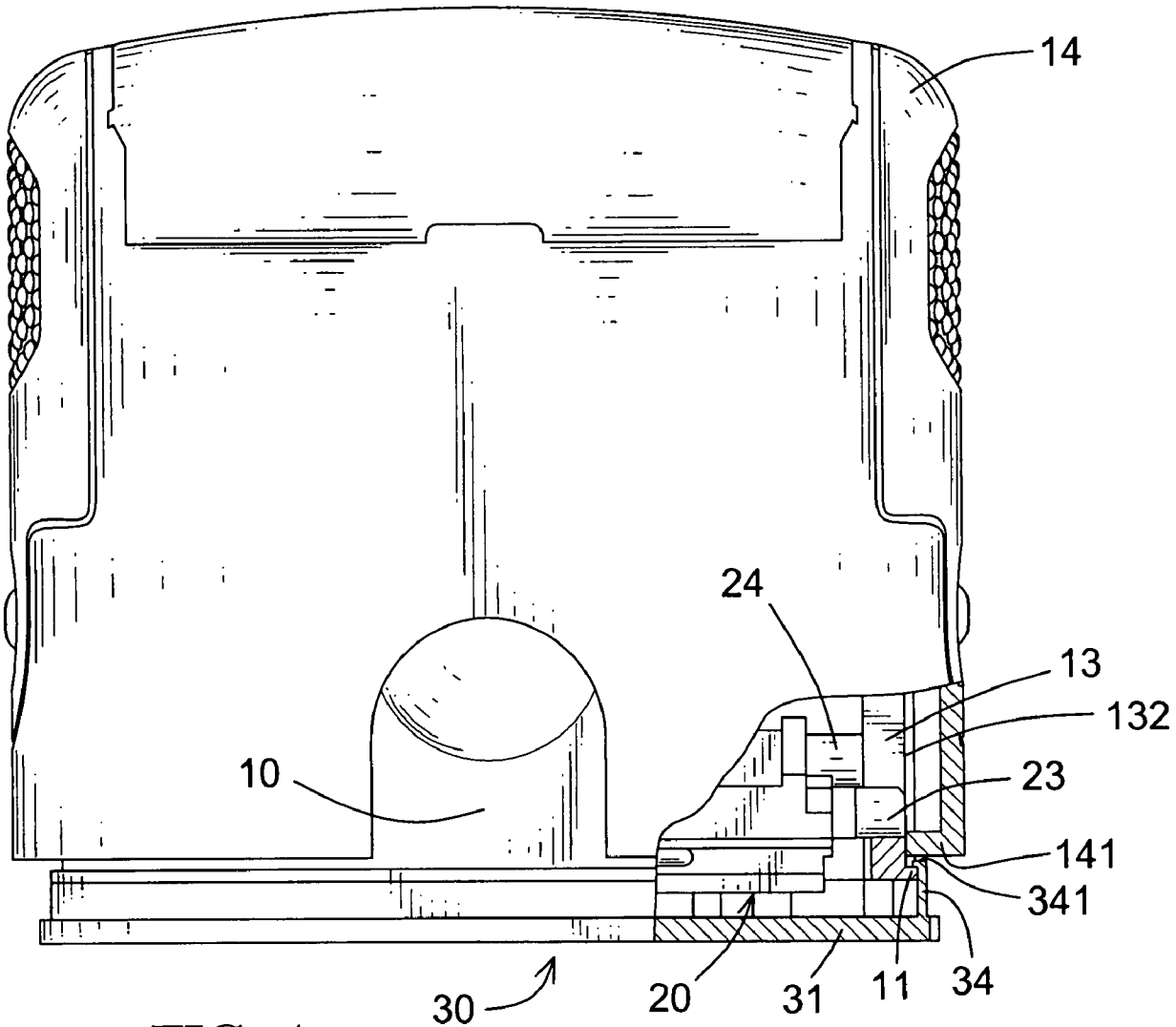
FIG. 4 is a front view in partial section of the automatically re-inked stamp in FIG. 1.

With reference to FIGS. 1–5, an automatically re-inked stamp has a stamp base (10), an ink pad (12), a character unit (20), a housing (14) and a bottom cover that attaches to the stamp base (10) without having to press the character unit (20) down.

The stamp base (10) is hollow and has a bottom, an opening, an edge, a lip (11), two vertical ends, two guide slots (13) and a rotator (131). The opening is at the bottom of the stamp base (10). The edge is at the bottom of the stamp base (10) around the opening. The lip (11) is formed on and extends out from the edge at the bottom. Each vertical end has an inside surface, an outside surface and a vertical channel (132). The vertical channels (132) are formed respectively in the outside surface of the vertical edges. The guide slots (13) are formed longitudinally respectively through the vertical ends. The rotator (131) is mounted on and protrudes in from the inside surface of the vertical end near the guide slot (13)

The ink pad (12) is mounted in the stamp base (10).

The character unit (20) is mounted rotatably and slidably in the stamp base (10) below the ink pad (12), moves up and down and has a rotor (21), a character plate (22), two lugs (24) and a shaft (23). The rotor (21) has a bottom face, a front edge, a rear edge, two ends and four optional ribs (211). Two ribs (211) are formed on the front and rear edges of the rotor (21). The character plate (22) is mounted on the bottom face of the rotor (21). Two lugs (24) are formed respectively on and protrude out from the ends of the rotor (21) and press against the rotator (131) when the character unit (20) slides up and down to rotate the character unit (20). The shaft (23) is mounted coaxially through the rotor (21) below the two lugs (24), protrudes from the ends of the rotor (21) and is mounted rotatably and slidably in the guide slots (13) in the stamp base (10).

The housing (14) is mounted over the stamp base (10), moves the rotor (21) up and down in the guide slots (13) in the stamp base (10) and has a biasing member, a bottom edge, an inside surface, two ends and two L-shaped rails (141). The biasing member is mounted between the housing (14) and the stamp base (10) to move the housing (14) up when the housing (14) is released. The L-shaped rails (141) are formed on the inside surface of the housing (14) respectively on the two ends at the bottom edge and are mounted slidably respectively in the vertical channels (132) in the stamp base (10).

Figure 5:
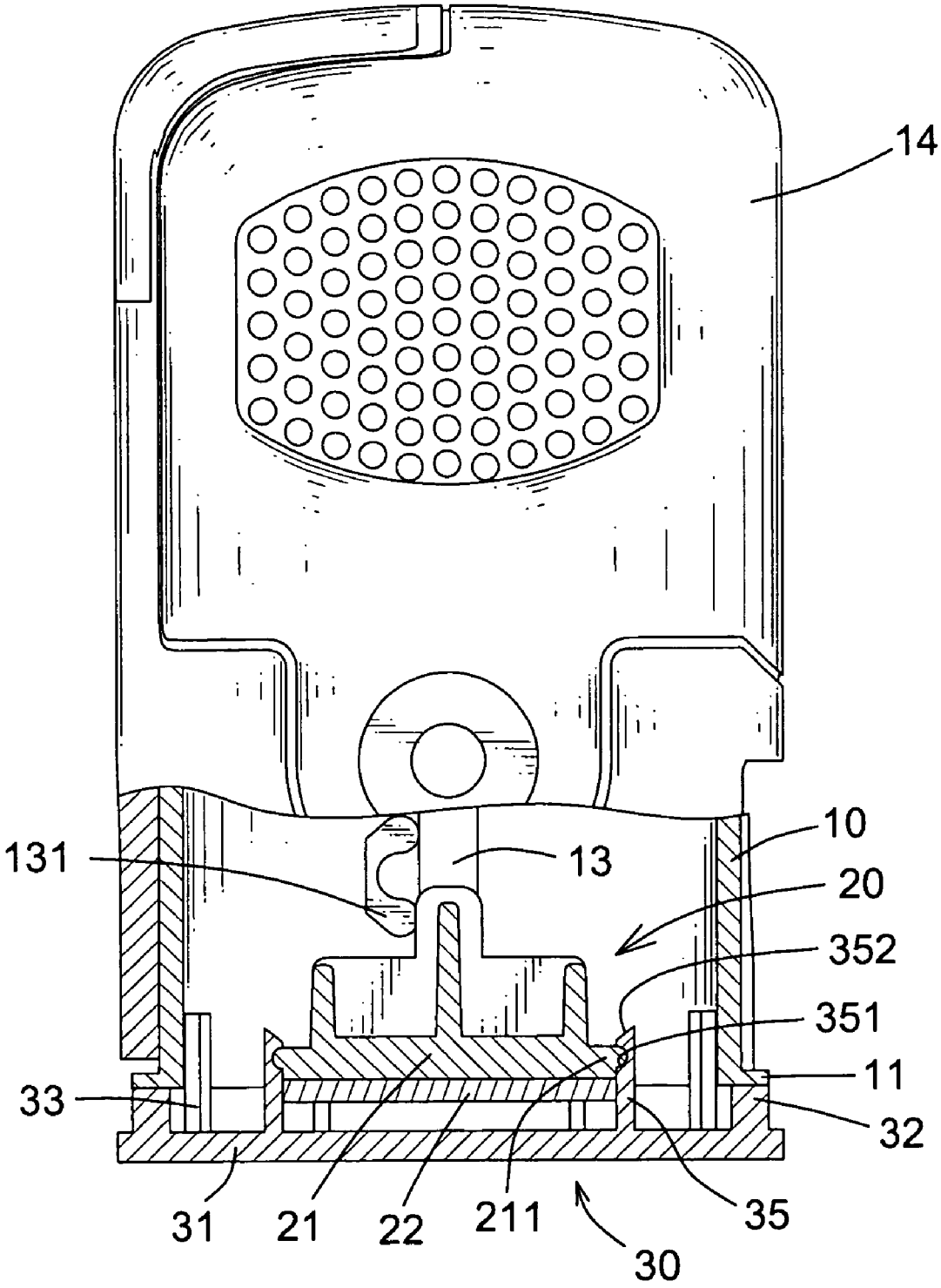
FIG. 5 is a side view in partial section of the automatically re-inked stamp in FIG. 1.
Figure 6:
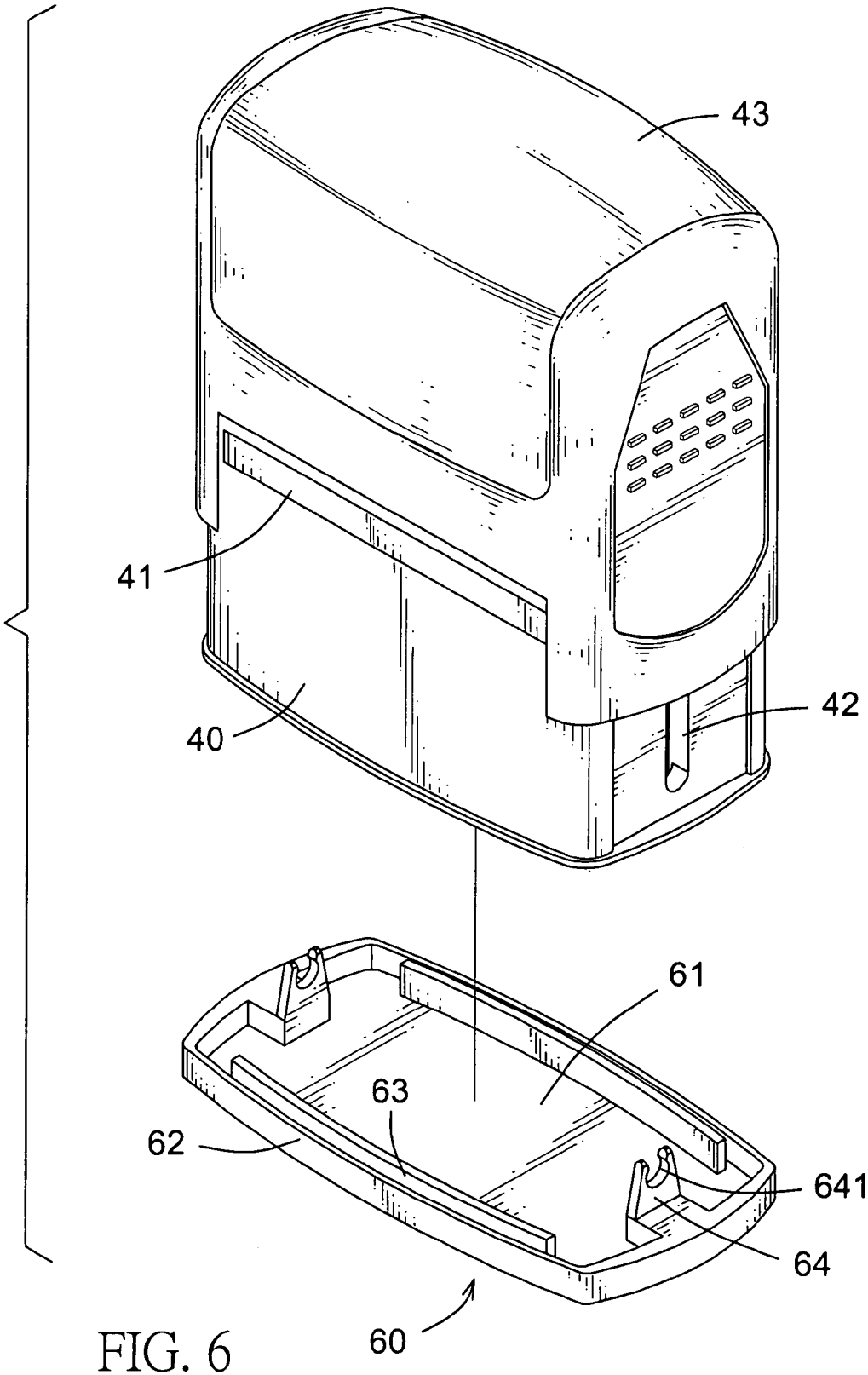
FIG. 6 PRIOR ART
FIG. 6 is a partially exploded perspective view of a conventional automatically re-inked stamp in accordance with the prior art.
Figure 7:
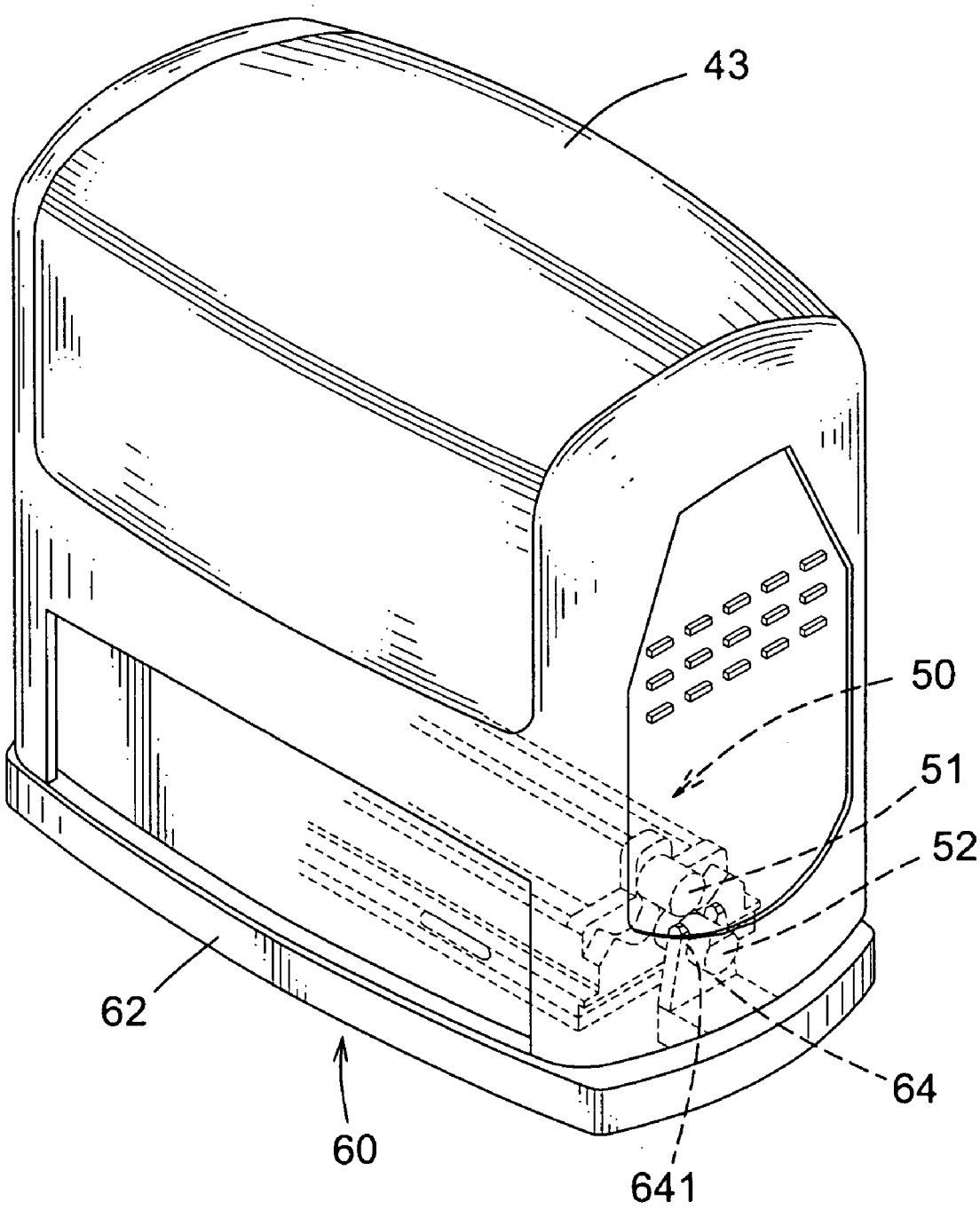
FIG. 7 PRIOR ART
FIG. 7 is a perspective view of the conventional automatically re-inked stamp in FIG. 6.

The bottom cover is mounted on the bottom of the stamp base (10) and has a bottom cap (30). With further reference to FIG. 5, the bottom cap (30) comprises a panel (31), an optional lip (32), multiple optional guide tabs (33), multiple optional clamps (35) and two latches (34). The panel (31) has a top surface, a front edge, a rear edge and two end edges. The lip (32) has a front section, a rear section and an inside surface and is formed on the top surface of the panel (31) at the front and rear edges. The guide tabs (33) are mounted on the inside surface of the lip (32) on the panel (31) and protrude up from the lip (32) to help align the bottom cap (30) with the stamp base (10) and mount the bottom cover on the stamp base (10). The clamps (35) are formed on and protrude up from the top surface of the panel (31) and correspond to the ribs (211) on the rotor (21), and each clamp (35) has a distal end (352) and a transverse detent (351). The distal ends (352) are inclined to pass easily over the ribs (211) on the rotor (21). The transverse detents (351) face inward and selectively hold the ribs (211) on the rotor (21) when the rotor (21) is pressed against the bottom cover, which holds the rotor (21) against the bottom cover. The latches (34) are formed respectively at and protrude up from the side edges of the panel (31), and each latch (34) has a distal end and a hook (341). The hooks (341) are formed respectively on the distal ends of the latches (34), extend in and hook the lip (11) on the stamp base (10) when the stamp base (10) is pressed onto the bottom cover.

After the bottom cap (30) is attached to the stamp base (10), when the housing (14) is pressed down, as shown in FIG. 5, the rotor (21) is overturned and the ribs (211) formed on the rotor (21) are further received in the transverse detent (351). Accordingly, the bottom cover is more secured with the stamp base (10). Consequently, even if the housing (14) is pressed, the bottom cover can also be securely held on the stamp base (10), which avoid contaminating the desk or documents.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An automatically re-inked stamp comprising a stamp base being hollow and having
- a bottom;
- an opening formed at the bottom;
- an edge formed at the bottom around the opening;
- a lip formed on and extending out from the edge at the bottom;
- two vertical ends, each vertical end having
  - an inside surface;
  - an outside surface; and
  - a vertical channel formed in the outside surface;
- two guide slots formed longitudinally respectively through the vertical ends; and
- a rotator mounted on and protruding in from the inside surface of one of the vertical ends near a corresponding guide slot;

an ink pad mounted in the stamp base;

a character unit mounted rotatably and slidably in the stamp base below the ink pad and having
- a rotor having
  - a bottom face;
  - a front edge;
  - a rear edge; and
  - two ends;
- a character plate mounted on the bottom face of the rotor;
- two lugs formed respectively on and protruding out from the ends of the rotor and pressing against the rotator when the character unit slides up and down to rotate the character unit; and a shaft mounted coaxially through the rotor below the two lugs, protruding from the ends of the rotor and mounted rotatably and slidably in the guide slots in the stamp base;

a housing mounted over the stamp base to move the rotor up and down in the guide slots in the stamp base and having a bottom edge;

an inside surface;

two ends; and two L-shaped rails formed on the inside surface of the housing respectively on the two ends at the bottom edge and mounted slidably respectively in the vertical channels in the stamp base;

a bottom cover mounted on the bottom of the stamp base, and having a bottom cap having a panel having a top surface, a front edge, a rear edge and two end edges; and two latches formed respectively at and protruding up from the side edges of the panel, and each latch having a distal end; and a hook formed on the distal end of the latch, extending in and hooking the lip on the stamp base when the stamp base is pressed onto the bottom cover.

2. The automatic re-inked stamp as referred in claim 1, wherein the bottom cap further comprises a lip having a front section, a rear section and an inside surface and formed on the top surface of the panel at the front and rear edges of the panel.

3. The automatic re-inked stamp as referred in claim 2, wherein the rotor further has four ribs with two ribs formed on the front and rear edges of the rotor; and the bottom cap further consists of multiple clamps formed on and protruding up from the top surface of the top surface of the panel and corresponding to the ribs on the rotor, and each clamp having a distal end inclined to pass easily over the corresponding rib on the rotor; and a transverse detent facing inward and selectively holding the corresponding rib on the rotor when the rotor is pressed against the bottom cover.

4. The automatic re-inked stamp as referred in claim 1, wherein the bottom cap further comprises multiple guide tabs mounted on the inside surface of the lip on the panel and protruding up from the lip on the panel.

5. The automatic re-inked stamp as referred in claim 2, wherein the bottom cap further comprises multiple guide tabs mounted on the inside surface of the lip on the panel and protruding up from the lip.

6. The automatic re-inked stamp as referred in claim 3, wherein the bottom cap further comprises guide tabs mounted on the inside surface of the lip on the panel and protruding up from the lip.

* * * * *